US006672866B1

(12) United States Patent
Fink et al.

(10) Patent No.: US 6,672,866 B1
(45) Date of Patent: Jan. 6, 2004

(54) CONTINUOUS FURNACE FOR TUBULAR FIRING MATERIAL

(75) Inventors: Ralf Fink, Reichenschwand (DE); Hans-Georg Hartmann, Nuremberg (DE); Jörg Ridder, Engelthal (DE)

(73) Assignee: Riedhammer GmbH (DE)

( * ) Notice: Subject to any disclaimer, the term of this patent is extended or adjusted under 35 U.S.C. 154(b) by 0 days.

(21) Appl. No.: 10/148,252

(22) PCT Filed: Aug. 16, 2000

(86) PCT No.: PCT/DE00/02810

§ 371 (c)(1),
(2), (4) Date: Oct. 1, 2002

(87) PCT Pub. No.: WO01/40729

PCT Pub. Date: Jun. 7, 2001

(30) Foreign Application Priority Data

Nov. 29, 1999 (DE) ..... 199 57 500

(51) Int. Cl.[7] ..... F27B 9/00

(52) U.S. Cl. ..... 432/121; 432/124; 432/236; 432/246

(58) Field of Search ..... 432/121, 124, 432/236, 246, 253

(56) References Cited

U.S. PATENT DOCUMENTS

| | | | | |
|---|---|---|---|---|
| 3,749,550 A | * | 7/1973 | Suydam | 432/122 |
| 3,951,583 A | * | 4/1976 | Carretta et al. | 432/124 |
| 4,025,298 A | * | 5/1977 | Tokitsu | 432/122 |
| 4,264,301 A | | 4/1981 | Booth | 432/124 |
| 4,609,345 A | | 9/1986 | Schroder et al. | 432/137 |
| 4,778,383 A | | 10/1988 | Strobel et al. | 432/241 |
| 5,890,890 A | | 4/1999 | Groom | 432/121 |

FOREIGN PATENT DOCUMENTS

| | | |
|---|---|---|
| DE | 1919982 | 11/1969 |
| DE | 23 46 909 | 3/1975 |
| DE | 196 17 717 A1 | 11/1997 |
| DE | 197 25 162 A1 | 12/1998 |
| GB | 2021743 A | 12/1979 |
| GB | 2149074 A | 6/1985 |

* cited by examiner

*Primary Examiner*—Jiping Lu
(74) *Attorney, Agent, or Firm*—Mark Kusner; Michael A. Jaffe

(57) ABSTRACT

A Conveyor furnace for firing pipe-shaped objects with the following characteristics:

Figure 1:
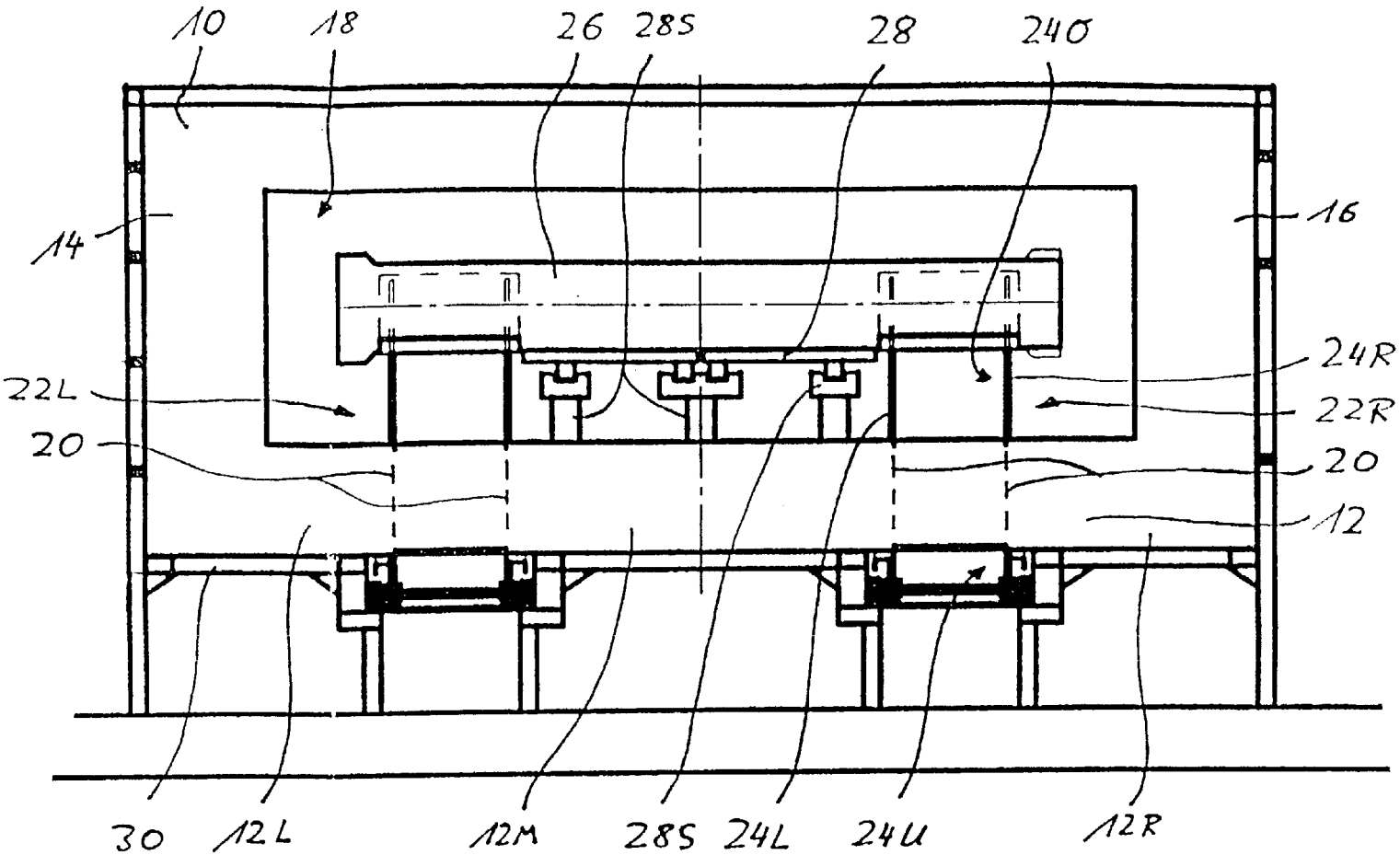

1.1.1 a furnace floor, 1.1.2 a furnace ceiling, 1.1.3 a two lateral furnace walls, which connect the furnace floor with the furnace ceiling, forming a furnace channel, 1.2 the furnace floor has at least one opening running in the axial direction of the furnace channel, 1.3.1 at least one transport unit that extends from a motor section below the furnace floor through the opening to a transport section in the furnace channel, and 1.3.2 which can be driven along the opening, 1.4 the transport section is designed to hold, in a horizontal position, at least one pipe-shaped object, 1.5 in the furnace channel below at least one part of the object to be fired, which is freely achievable, a device is arranged, onto which the object first rolls up, with its freely achievable part, and then rolls down.

16 Claims, 2 Drawing Sheets

10
14
16
18
20
22L
22R
24O
24R
24U
24L
26
28
28S
28S
12
12R
12M
12L
30

CONTINUOUS FURNACE FOR TUBULAR FIRING MATERIAL

The invention concerns a continuously operated furnace for firing pipe-shaped objects particularly rotation-symmetrical material such as ceramic pipes, It is a know practice to convey ceramic pipes through a furnace channel in a vertical position in transport units designed for this purpose. As with other conveyor furnaces, the objects to be fired are first heated in an initial heating zone, then fired in a firing zone, and finally cooled down enough to be removed from the furnace in a cooling zone. The firing time can amount to as much as three days.

Firing pipe-shaped objects often involves the problem of these objects becoming slightly deformed due to their great length relative to diameter. This happens particularly in the temperature range above 800° C., when ceramic material softens and becomes slightly distorted.

The idea behind this invention was therefore to devise a conveyor furnace for firing pipe-shaped objects in which heat treatment times are as short as possible, thus causing minimum deformation of the objects being fired.

The following idea formed the basis for the invention: when pipes are conveyed through the furnace for firing in a vertical position, deformation can result from the effects of gravitation in the temperature areas mentioned above. This applies to both standing and hanging transport of pipes for firing. The transport of pipes lying on a furnace trolley, which is used in fine ceramics production, is impossible, because the length of the pipes would require correspondingly broad furnace trolleys. This would require heating and cooling the considerable mass represented by the furnace trolleys, which is not feasible in terms of energy use. In addition, there is the risk than a pipe with a round cross-section will turn into a pipe with an oval cross-section during firing.

This invention is therefore based on the concept of replacing "static" conveyance of objects through the furnace, a process where the objects being fired remain in the same position on or adjacent to a transport device, by "at least partially rotating" transport, where the objects undergoing firing rotate during conveyance through the furnace, at least in the furnace zone where they would be susceptible to deformation.

A further development of this idea provides for objects to be conveyed through the furnace channel in a horizontal position on a transport device. At a certain point along the way, there is another device onto which the objects roll. This device catches an exposed area of the objects (an area outside the supporting areas of the transport unit), whereby it slightly takes off from the supporting area and the objects then roll (or rotate) along on this device during further conveyance by the transport unit.

This ensures that the objects, particularly in kiln areas where they are highly susceptible to deformation due to softening of their constituent material, rest on a more or less large- surface, rotating as they pass over this surface, which ensures that any potential deformation is immediately corrected due to the rotating movement of the objects.

In its general form, the invention applies to a conveyor furnace for pipe-shaped objects and can be constructed in two versions. The first version has the following characteristics:

- furnace floor
- furnace ceiling
- two lateral furnace walls, which together with the furnace floor and furnace ceiling form the furnace channel,

- a furnace floor with at least one continuous opening running in the axial direction of the furnace channel,
- at least one transport unit that extends from a motor section underneath the furnace floor up through the opening and into the transport section of the furnace channel, and which can be moved along the opening,

- the transport section is designed to carry at least one pipe-shaped object in a horizontal position, and in the furnace channel, below at least one exposed free available section of the object, there is at least one device that catches the object during transport through the channel, the object rolling first up onto this device and then rolling off the device.

In this version, the transport device extends through the floor of the furnace. The second version differs from the first in that the transport unit is attached to the furnace ceiling. This version differs from the first version in the following ways:

- instead of an opening in the furnace floor, this version has at least one continuous opening in the furnace ceiling, this opening running in the axial direction of the furnace channel,
- it has at least one transport unit that extends from a motor section located above the furnace ceiling through the opening into a transport section located in the furnace channel.

All other characteristics are the same as those of the first version.

Both versions can be supplied with a two-part transport device, each extending through an opening in the furnace floor or the furnace ceiling.

The openings can be adjacent to (and parallel to) either furnace wall. "Adjacent" means that the ends of the pipe-shaped objects, whose length should normally be only slightly shorter than the width of the furnace channel, can extend beyond the respective transport sections. The part of the object that extends beyond the transport section in question could be the flange area at the end of a ceramic sewer pipe, for example. This ensures that the object is conveyed in an exactly horizontal position.

In the case of a two-part transport unit, the two components should obviously be synchronized (adjusted) so that the object can be transported through the furnace channel in a precisely aligned position.

The transport units can extend beyond the ends of the furnace channel in order to facilitate loading and unloading with workpieces to be fired. They can then be returned to the furnace entrance by passing above, beside, or under the furnace.

The transport sections of the transport unit may consist of a framework extending in the axial direction of the kiln channel, which has at least one horizontal lower shank, on which objects can be placed for the firing process.

The transport unit can also comprise two supporting arms for the objects to be fired, the arms being placed at a distance from each other, in a position perpendicular to the axial direction of the kiln channel.

When there are two transport units, there will be two supporting arms on both ends of the pipe-shaped objects for firing, making a total of four.

The transport sections can be constructed to accommodate one or more objects for firing. When there are several objects, they can be placed as well side by side (along a horizontal plane).

The motor section of the transport unit may have rollers or wheels that move on corresponding tracks/rails.

In the case of the first version, where the transport unit extends through the floor of furnace, it is possible to affix wheels that run on tracks to the lower end of the transport unit, as is done with conventional furnace trolleys.

In the second version, the part of the transport unit located above the furnace ceiling can run on wheels that run on tracks, in a manner similar to a suspension railway. The unit can be driven by a pushing unit, an endless chain or other means.

In order to achieve a specified furnace atmosphere, it is necessary to prevent, as far as possible, an exchange of gases between the kiln channel and the ambient atmosphere. Insofar an embodiment proposes to arrange the opening in a gas tight manner with respect to the furnace channel. This can be done by having the transport unit follow a meandering path through the opening and/or by gaskets. As a rule, a relatively airtight seal is sufficient.

As described above, an essential feature of the conveyor furnace is the table that takes the objects being fired, and along which these objects move with a rotating motion. This device may comprise a table that inclines in the direction of the furnace floor to either end of the conveyor tunnel (to the furnace entrance and exit).

The inclined surfaces can be arranged so that the free ends are located below the objects carried in the transport unit. This will ensure that the objects, during transport through the furnace, will not roll up onto the first inclined surface (the one rising in the direction of transport) until the objects have actually arrived at a position above this sloping surface. This will ensure that the objects roll gently up onto the inclined surface.

Once the objects being fired have rolled up onto the inclined surface, they continue to move in the direction of the furnace exit, activated by the transport unit, and because the inclined surface rises in that direction, they are lifted slightly off the supporting surfaces of the transport unit, so that the objects now rest only on the inclined surface. During further transport, the objects roll upwards along this inclined surface—due to the force of traction—to its highest point, after which they roll downwards along the inverse (opposite) inclined surface, until they are again caught by the supporting surfaces of the transport unit and conveyed to the furnace exit by the transport unit.

As mentioned above, when firing ceramic objects, the device can be arranged along the section of the furnace where temperatures might be over 800° C. for example, which are the areas of the furnace where the temperature is above that at which the constituent materials of these objects soften.

In the case of a device with two transport units each arranged close to the furnace walls, the device may be arranged between the furnace walls.

In this case, it is advantageous to have the device designed as wide as possible, in order to provide supporting surface as big as possible for the objects being fired. In one embodiment, the width of the device corresponds to at least half the length of the objects being fired.

The part of each transport section that enters into the kiln channel, at least, can be made of a refractory ceramic material, particularly when maximum temperatures in the furnace are above the softening temperature of metallic materials.

It might also be necessary for the device to be made of refractory ceramic materials.

This applies particularly when firing ceramic products that have a sintering temperature above 1000° C. In such cases, the device is to be located along the kiln's firing zone.

In the case of other uses, the transport unit and the device can be made of metallic or high-temperature resistant materials.

Other characteristics of the invention can be found in the sub-claims and the other application documentation.

In this respect the device can also have a horizontal section between the inclined surfaces described above, or alternating inclined surfaces (in the direction of transport of the objects being fired).

The device will be described in more detail below showing possible embodiments in schematic terms. It is shown in:

FIG. 1: a cross-section of the firing zone of a first version of a conveyor furnace.

Figure 2:
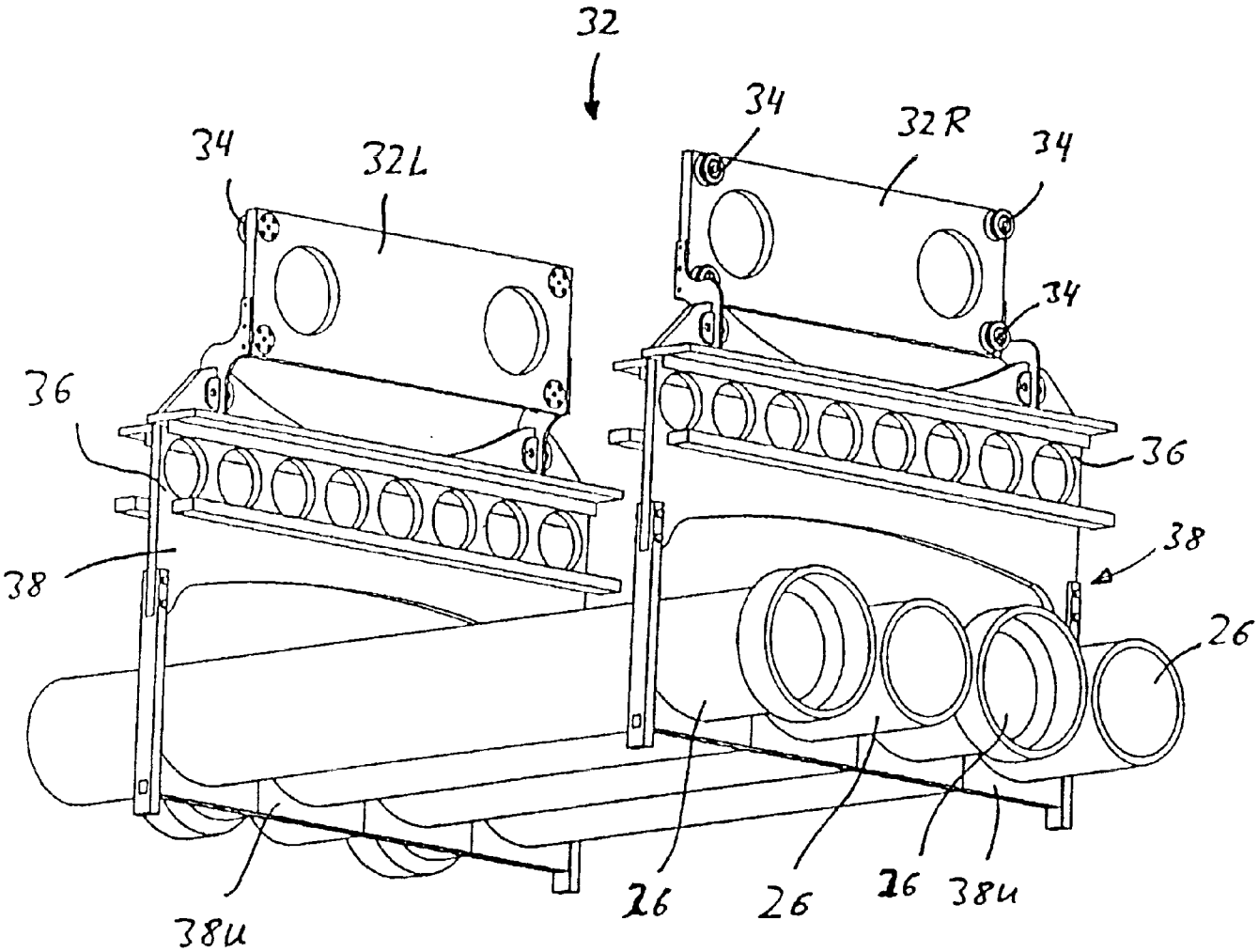

FIG. 2: a transport unit for a second version of a conveyor furnace.

In FIG. 1, reference numeral 10 is used for the furnace ceiling, reference numeral 12 for the furnace floor, and reference numerals 14 and 16 for the furnace walls.

The latter enclose furnace channel 18, which extends from a furnace entrance (not shown) to a furnace exit (not shown).

The furnace floor (12) has four openings, drawn with hatching (20), which extend across the entire length of furnace floor (12) in the axial direction of the furnace channel (18). Two transport units (22L, 22R) extend through the openings (20). They are identical in construction and will be described in more detail below on the basis of transport unit 22R. This transport unit (22R) comprises two side faces (24L, 24R) arranged at a distance to each other. Section 24U, projecting below the furnace floor (12), is a motor section and is therefore shown with wheels that run on tracks (the tracks running in the axial direction of furnace channel 18).

Section 240, which projects above the furnace floor, serves as a transport section, the side faces 24L, 24R of which are U-shaped at its upper ends (in a view perpendicular to the axial direction of the furnace channel), which enable them to catch a ceramic pipe 26 horizontally, the pipe then being carried forward on four supporting surfaces (on each side face 24L, 24R).

Between transport units 22L, 22R there is a table 28 that rests on three pillars 28S.

The table 28, looking in the direction of transport for the stoneware pipe 26, which corresponds to the axial direction of the furnace tunnel 18, is constructed in the following manner: it begins with an inclined surface, whose lowest end is located below the supporting area of the pipe 26, its highest end being at least a few centimeters above this supporting area.

It is followed by another inclined surface (a mirror image of the first), which declines in the direction of transport of the ceramic pipe 26.

After the pipe 26 has been heated in the preheating zone of the furnace, it enters the firing zone of the furnace where the table 28 is located. The pipe 26 rolls up onto the first inclined surface of this table 28 and rotates during further transport (by transport units 22L, 22R), during which it is initially lifted from the support areas of side faces 24L and 24R, and then placed back on them.

The pipe 26 is then conveyed through the cooling zone to the furnace exit via transport units 22L, 22R.

Sections 12L, 12M, 12R separated by openings 20 are supported from below by a metal frame construction 30.

The transport unit 32 depicted in FIG. 2 comprises two motor sections 32L, 32R, which correspond in function to the motor sections 24U in FIG. 1.

These motor sections are provided with rollers 34 that run on tracks (not shown) located above the furnace ceiling.

While sections signified by 36 extend through corresponding openings in the furnace ceiling, lower sections 38, which correspond in function to the transport sections 240 according to FIG. 1, protrude into the furnace channel of this construction. They each consist of a framework construction with a lower support 38U, on which four ceramic pipes 26 rest side by side.

The transport unit 32 moves through the furnace channel by means of said rollers 34, and the ceramic pipes 26, as depicted in FIG. 1, which shows one embodiment of the device, roll up onto a table 28 of the kind described above, and then roll off this table, being carried forward with a rotating motion (around their own axe).

What is claimed is:

1. Conveyor furnace for firing pipe-shaped objects (26) with the following characteristics:

1.1.1 a furnace floor (12), 1.1.2 a furnace ceiling (10), 1.1.3 a two lateral furnace walls (14, 16), which connect the furnace floor (12) with the furnace ceiling (10), forming a furnace channel (18), 1.2 the furnace floor (12) has at least one opening (20) running in the axial direction of the furnace channel (18), 1.3.1 at least one transport unit (22L, 22R) that extends from a motor section (24U) below the furnace floor (12) through the opening (20) to a transport section (240) in the furnace channel (18), and 1.3.2 which can be driven along the opening (20), 1.4 the transport section (240) is designed to hold, in a horizontal position, at least one pipe-shaped object (26), 1.5 in the furnace channel (18) below at least one part of the object to be fired, which is freely achievable, a device (28) is arranged, onto which the object first rolls up, with its freely achievable part, and then rolls down.

2. Conveyor furnace for firing pipe-shaped objects (26), with the following characteristics:

2.1.1 a furnace floor (12), 2.1.2 a furnace ceiling (10), 2.1.3 two lateral furnace walls (14, 16), which connect the furnace floor (12) with the furnace ceiling (10), forming a furnace channel (18)

2.2 the furnace ceiling (10) has at least one continuous opening (18) running in the axial direction of the furnace channel (18), 2.3.1 at least one transport unit (32) that extends from a motor section (32L, 32R) above the furnace ceiling (18) through the opening into a transport section (38) in the furnace channel (18), and 2.3.2 which can be driven along the opening (20), 2.4 the transport section (240) is designed to hold, in a horizontal position, at least one pipe-shaped object (26), 2.5 in the furnace channel (18) below at least one part of the object to be fired, which is freely achievable, a device (28) is arranged, onto which the object first rolls up, with its freely achievable part, and then rolls down.

3. Conveyor furnace according to claim 1 or 2 with a two-part transport unit (22L, 22R, 32), in which each component (22L, 22R; 32L, 32R) extends through a corresponding opening (20).

4. Conveyor furnace according to claim 3, in which the openings (20) are located adjacent to each furnace wall (14, 16).

5. Conveyor furnace according to claim 1 or 2, wherein the transport section (240, 38) of the transport unit (22L, 22R;32) comprises a framework with a lower horizontal shank (38U) extending in the axial direction of the furnace channel (18).

6. A conveyor furnace according to claim 1 or 2, in which the transport section (38) is designed to accommodate several objects for firing (26) side by side.

7. A conveyor furnace according to claim 1 or 2, wherein the motor section (24U; 32L, 32R) of the transport unit (24L, 24R; 32) has rollers or wheels (34) to carry it along corresponding tracks.

8. A conveyor furnace according to claim 1 or 2, wherein the opening (20) is airtight with respect to the furnace channel (18).

9. A conveyor furnace according to claim 1 or 2, wherein the device (28) comprises a table with surfaces inclining in the direction of the furnace floor (12) to the end sections of the furnace tunnel (18).

10. A conveyor furnace according to claim 9, where the free ends of the inclined surfaces are located below the objects (26) carried in the transport section (240, 38).

11. A conveyor furnace according to claim 1 or 2, wherein the device (28) runs between the furnace walls (14, 16).

12. A conveyor furnace according to claim 1 or 2, where the device (28) has a width corresponding to at least half the length of the objects being fired (26).

13. A conveyor furnace according to claim 1 or 2, wherein each transport section (240, 38) has two support areas (38U), arranged at a distance to each other perpendicular to the axial direction of the conveyor tunnel (18), for the objects being fired (26).

14. A conveyor furnace according to claim 1 or 2, wherein at least the section of each transport unit (22L, 22R; 32) that projects into the furnace channel (18) is made of a refractory ceramic material.

15. A conveyor furnace according to claim 1 or 2, wherein the device (28) is made of a refractory ceramic material.

16. A conveyor furnace according to claim 1 or 2, wherein the device (28) is mounted along the firing zone of the conveyor furnace.

* * * * *